US011572800B2

(12) United States Patent
Bifulco

(10) Patent No.: US 11,572,800 B2
(45) Date of Patent: Feb. 7, 2023

(54) BORESCOPE PORT ENGINE FLUID WASH

(71) Applicant: RAYTHEON TECHNOLOGIES CORPORATION, Farmington, CT (US)

(72) Inventor: Anthony R. Bifulco, Ellington, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 1 day.

(21) Appl. No.: 17/155,876

(22) Filed: Jan. 22, 2021

(65) Prior Publication Data

US 2021/0254500 A1 Aug. 19, 2021

Related U.S. Application Data

(60) Provisional application No. 62/976,825, filed on Feb. 14, 2020.

(51) Int. Cl.

| | |
|---|---|
| ***F01D 25/00*** | (2006.01) |
| ***B08B 9/032*** | (2006.01) |
| ***B08B 9/093*** | (2006.01) |

(52) U.S. Cl.

CPC ..... *F01D 25/002* (2013.01); *B08B 9/0321* (2013.01); *B08B 9/0936* (2013.01); *B08B 2209/032* (2013.01); *F05D 2220/32* (2013.01); *F05D 2230/72* (2013.01)

(58) Field of Classification Search

CPC ..... F01D 25/002; B08B 9/0936; B08B 9/093

See application file for complete search history.

(56) References Cited

U.S. PATENT DOCUMENTS

| | | | |
|---|---|---|---|
| 9,492,906 | B2 | 11/2016 | Rösing et al. |
| 10,227,891 | B2 | 3/2019 | Eriksen et al. |
| 10,323,539 | B2 | 6/2019 | Bewlay et al. |

(Continued)

FOREIGN PATENT DOCUMENTS

| | | |
|---|---|---|
| DE | 102011015252 | 10/2012 |
| DE | 102016206246 | 10/2017 |
| EP | 2818908 | 12/2014 |

OTHER PUBLICATIONS

European Patent Office, European Search Report dated Jul. 12, 2021 in Application No. 21156707.8.

*Primary Examiner* — Joseph L. Perrin
*Assistant Examiner* — Kevin G Lee
(74) *Attorney, Agent, or Firm* — Snell & Wilmer L.L.P.

(57) ABSTRACT

A fluid wash system for a gas turbine engine is disclosed, the gas turbine engine defining an axial direction and comprising a borescope port that provides access to a component within a core flow path of the gas turbine engine. In various embodiments, the fluid wash system includes a wash line fluidly connected to a pump configured to provide a pressurized flow of wash liquid; a spray nozzle connected to the wash line and configured for extending into the borescope port to provide the pressurized flow of wash liquid to the component within the core flow path; and an attachment mechanism configured to releasable mount the spray nozzle to the borescope port, the attachment mechanism including an alignment mechanism configured to orient the spray nozzle and direct the pressurized flow of wash liquid in a predetermined direction toward the component.

14 Claims, 6 Drawing Sheets

(56) References Cited

U.S. PATENT DOCUMENTS

| | | | | |
|---|---|---|---|---|
| 2009/0084411 | A1* | 4/2009 | Woodcock | F23J 1/02 134/22.18 |
| 2013/0199040 | A1 | 8/2013 | Dudeck et al. | |
| 2014/0034091 | A1* | 2/2014 | Dorshimer | B08B 3/02 134/198 |
| 2017/0056940 | A1* | 3/2017 | Segler | B05B 15/00 |
| 2018/0149038 | A1 | 5/2018 | Eriksen et al. | |
| 2018/0283209 | A1* | 10/2018 | Eriksen | B08B 9/00 |
| 2019/0292938 | A1 | 9/2019 | Wang | |

* cited by examiner

BORESCOPE PORT ENGINE FLUID WASH

CROSS-REFERENCE TO RELATED APPLICATIONS

This application is a non-provisional application claiming priority to U.S. Prov. Appl. 62/976,825, entitled "BORESCOPE PORT ENGINE FLUID WASH," filed on Feb. 14, 2020, the entirety of which is hereby incorporated by reference herein for all purposes.

FIELD

The present disclosure relates to gas turbine engines and, more particularly, to apparatus and methods used to fluid wash gas turbine engines.

BACKGROUND

Deposits or debris formed on the various rotor blades or stator vanes within the compressor and the turbine sections in a gas turbine engine impair the aerodynamic condition and dynamics of the engine, thereby affecting efficiency. Similar buildups of deposits or debris on other components within a gas turbine engine, such as, for example, struts, flow path surfaces and combustor panels, may also impair the affect the efficiency of the engine during operation. Accordingly, at various maintenance intervals, it is desirable to wash the engine in order to reduce build-up on the blades or vanes or other components within a gas turbine engine. Accessing various blade or vane stages may prove difficult from the engine inlet or exhaust, thereby often requiring washing the engine either by removing other engine equipment, such as bleed valves, or by using dedicated borescope or wash ports to provide access to the engine interior. Conventional approaches may be time consuming or difficult to provide access for cleaning purposes, which results in poor cleaning.

SUMMARY

A fluid wash system for a gas turbine engine is disclosed, the gas turbine engine defining an axial direction and comprising a borescope port that provides access to a component within a core flow path of the gas turbine engine. In various embodiments, the fluid wash system includes a wash line fluidly connected to a pump configured to provide a pressurized flow of wash liquid; a spray nozzle connected to the wash line and configured for extending into the borescope port to provide the pressurized flow of wash liquid to the component within the core flow path; and an attachment mechanism configured to releasably mount the spray nozzle to the borescope port, the attachment mechanism including an alignment mechanism configured to orient the spray nozzle and direct the pressurized flow of wash liquid in a predetermined direction toward the component.

In various embodiments, the attachment mechanism includes a base and the alignment mechanism includes a key extending from the base and configured for engagement with a slot that is cut into a boss configured to receive the base. In various embodiments, the spray nozzle includes an orifice configured to expel the pressurized flow of wash liquid toward the component. In various embodiments, the predetermined direction is within a range of about zero degrees to about ninety degrees in a radial inward direction with respect to the axial direction. In various embodiments, the spray nozzle is a first spray nozzle configured for mounting to the attachment mechanism and configured for orientation with respect to the component at a first predetermined direction and, in various embodiments, the fluid wash system further includes a second spray nozzle configured for mounting to the attachment mechanism and configured for orientation with respect to the component at a second predetermined direction. In various embodiments, the spray nozzle includes a plurality of orifices configured to expel the pressurized flow of wash liquid toward the component.

In various embodiments, the attachment mechanism includes a base and the alignment mechanism includes a slot that is cut into the base and configured to engage a pin extending from a boss configured to receive the base. In various embodiments, the spray nozzle includes an orifice configured to expel the pressurized flow of wash liquid toward the component in a direction within a range of about zero degrees to about ninety degrees in a radial inward direction with respect to the axial direction and wherein the spray nozzle is rotatable with respect to the base. In various embodiments, the spray nozzle includes a plurality of orifices configured to expel the pressurized flow of wash liquid toward the component.

In various embodiments, the attachment mechanism includes a base and the alignment mechanism includes a plurality of tines extending circumferentially about the base and configured to engage a plurality of slots that are cut into a boss configured to receive the base. In various embodiments, the spray nozzle includes an orifice configured to expel the pressurized flow of wash liquid toward the component in a direction within a range of about zero degrees to about ninety degrees in a radial inward direction with respect to the axial direction. In various embodiments, the spray nozzle includes a plurality of orifices configured to expel the pressurized flow of wash liquid toward the component.

A fluid wash system for a gas turbine engine is disclosed, the gas turbine engine defining an axial direction and comprising a plurality of borescope ports. In various embodiments, the fluid wash system includes a pump configured to output a pressurized flow of wash liquid; a nozzle distribution assembly fluidly connected to the pump for receiving the pressurized flow of wash liquid; a plurality of wash lines fluidly connected to the nozzle distribution assembly; and a plurality of spray nozzles, each of the plurality of spray nozzles connected by an attachment mechanism to a respective one of the plurality of wash lines and configured for extending at least partially into or through one of the plurality of borescope ports of the gas turbine engine for providing a portion of the pressurized flow of wash liquid to a component within the gas turbine engine, the attachment mechanism including an alignment mechanism.

In various embodiments, the attachment mechanism includes a base and the alignment mechanism includes a key extending from the base and configured for engagement with a slot that is cut into a boss configured to receive the base. In various embodiments, the attachment mechanism includes a base and the alignment mechanism includes a slot that is cut into the base and configured to engage a pin extending from a boss configured to receive the base. In various embodiments, the attachment mechanism includes a base and the alignment mechanism includes a plurality of tines extending circumferentially about the base and configured to engage a plurality of slots that are cut into a boss configured to receive the base.

A method of washing a gas turbine engine having a borescope hole providing access to a component within a core flow path is disclosed. In various embodiments, the method includes the steps of removing a plug from the borescope hole; inserting a spray nozzle into the borescope hole; and attaching the spray nozzle to the borescope hole using an attachment mechanism, the attachment mechanism including an alignment mechanism configured to orient the spray nozzle and direct a pressurized flow of wash liquid in a predetermined direction toward the component.

In various embodiments, the attachment mechanism includes a base and the alignment mechanism includes a key extending from the base and configured for engagement with a slot that is cut into a boss configured to receive the base. In various embodiments, the attachment mechanism includes a base and the alignment mechanism includes a slot that is cut into the base and configured to engage a pin extending from a boss configured to receive the base. In various embodiments, the attachment mechanism includes a base and the alignment mechanism includes a plurality of tines extending circumferentially about the base and configured to engage a plurality of slots that are cut into a boss configured to receive the base.

The forgoing features and elements may be combined in any combination, without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the following detailed description and claims in connection with the following drawings. While the drawings illustrate various embodiments employing the principles described herein, the drawings do not limit the scope of the claims.

DETAILED DESCRIPTION

The following detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that changes may be made without departing from the scope of the disclosure. Thus, the detailed description herein is presented for purposes of illustration only and not of limitation. Furthermore, any reference to singular includes plural embodiments, and any reference to more than one component or step may include a singular embodiment or step. Also, any reference to attached, fixed, connected, or the like may include permanent, removable, temporary, partial, full or any other possible attachment option. Additionally, any reference to without contact (or similar phrases) may also include reduced contact or minimal contact. It should also be understood that unless specifically stated otherwise, references to "a," "an" or "the" may include one or more than one and that reference to an item in the singular may also include the item in the plural. Further, all ranges may include upper and lower values and all ranges and ratio limits disclosed herein may be combined.

Figure 1:
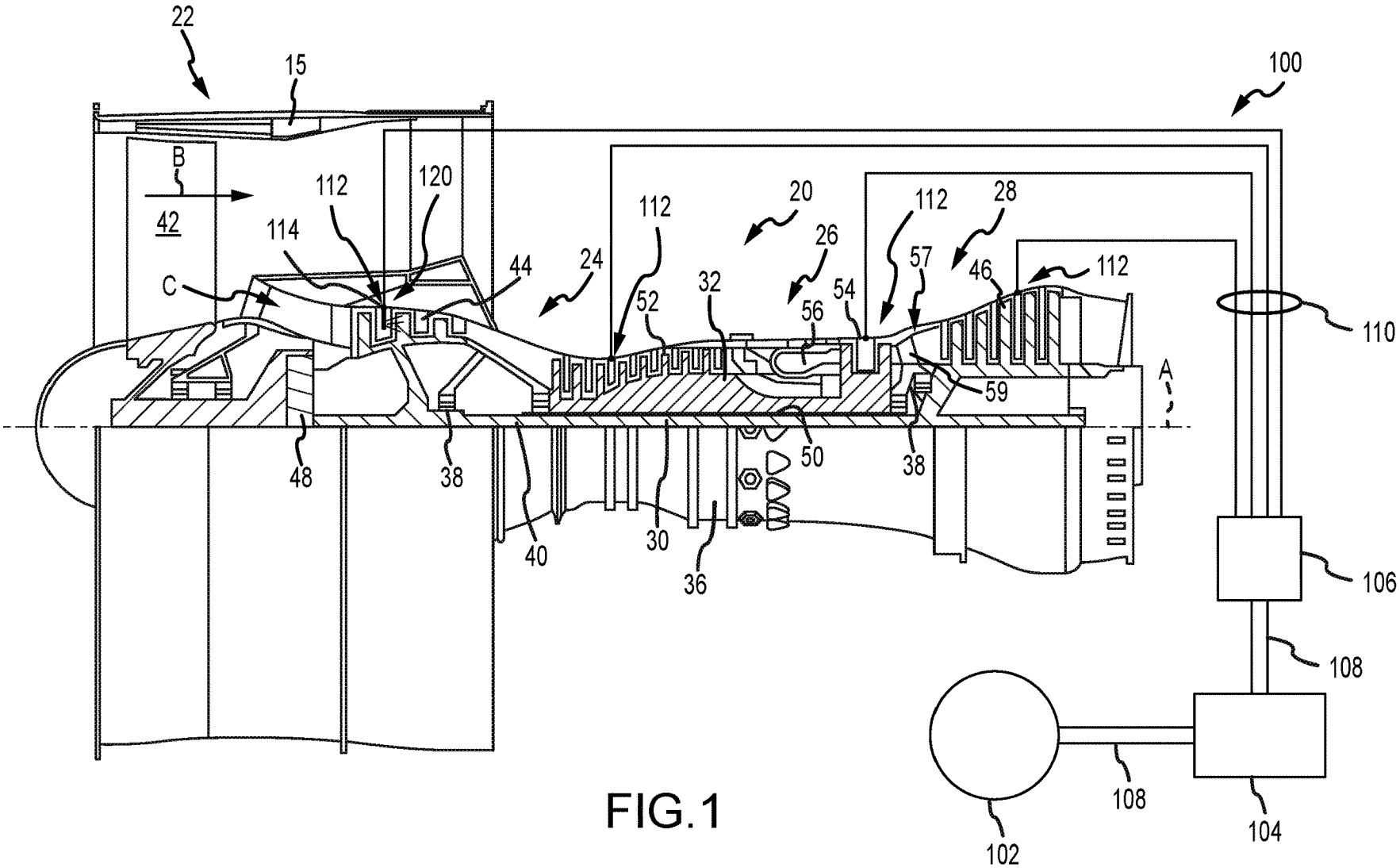
FIG. 1 is a cross sectional schematic view of a gas turbine engine, in accordance with various embodiments.

Referring now to the drawings, FIG. 1 schematically illustrates a gas turbine engine 20, in accordance with various embodiments. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a nacelle 15, while the compressor section 24 drives air along a primary or core flow path C for compression and communication into the combustor section 26 and then expansion through the turbine section 28. Although depicted as a two-spool turbofan gas turbine engine in the disclosed non-limiting embodiment, it will be understood that the concepts described herein are not limited to use with two-spool turbofans, as the teachings may be applied to other types of gas turbine engines, including, for example, architectures having three or more spools or only a single spool.

The gas turbine engine 20 generally includes a low speed spool 30 and a high speed spool 32 mounted for rotation about an engine central longitudinal axis A relative to an engine static structure 36 via several bearing systems 38. It should be understood that various bearing systems at various locations may alternatively or additionally be provided and the location of the several bearing systems 38 may be varied as appropriate to the application. The low speed spool 30 generally includes an inner shaft 40 that interconnects a fan 42, a low pressure compressor 44 and a low pressure turbine 46. The inner shaft 40 is connected to the fan 42 through a speed change mechanism, which, in this gas turbine engine 20, is illustrated as a fan drive gear system 48 configured to drive the fan 42 at a lower speed than that of the low speed spool 30. The high speed spool 32 generally includes an outer shaft 50 that interconnects a high pressure compressor 52 and a high pressure turbine 54. A combustor 56 is arranged in the gas turbine engine 20 between the high pressure compressor 52 and the high pressure turbine 54. A mid-turbine frame 57 of the engine static structure 36 is arranged generally between the high pressure turbine 54 and the low pressure turbine 46 and may include airfoils 59 in the core flow path C for guiding the flow into the low pressure turbine 46. The mid-turbine frame 57 further supports the several bearing systems 38 in the turbine section 28. The inner shaft 40 and the outer shaft 50 are concentric and rotate via the several bearing systems 38 about the engine central longitudinal axis A, which is collinear with longitudinal axes of the inner shaft 40 and the outer shaft 50.

The air in the core flow path C is compressed by the low pressure compressor 44 and then the high pressure compressor 52, mixed and burned with fuel in the combustor 56, and then expanded over the high pressure turbine 54 and the low pressure turbine 46. The low pressure turbine 46 and the high pressure turbine 54 rotationally drive the respective low speed spool 30 and the high speed spool 32 in response to the expansion. It will be appreciated that each of the positions of the fan section 22, the compressor section 24, the combustor section 26, the turbine section 28, and the fan drive gear system 48 may be varied. For example, the fan drive gear system 48 may be located aft of the combustor section 26 or even aft of the turbine section 28, and the fan section 22 may be positioned forward or aft of the location of the fan drive gear system 48.

Still referring to FIG. 1, a fluid wash system 100 is illustrated, in accordance with various embodiments. The fluid wash system 100 includes a fluid supply 102, a fluid pump 104 and a fluid distribution assembly 106, each of which may be interconnected by a fluid supply conduit 108. A plurality of fluid wash lines 110 run from the fluid distribution assembly 106 to a plurality of engine ports 112, each of which typically extends through an engine casing that defines an outer boundary of the core flow path C. In various embodiments, for example, one or more of the plurality of engine ports 112 may comprise a borescope port 114 (or a plurality of borescope ports extending axially along the engine and circumferentially about the engine) configured to introduce a borescope into the core flow path C or other parts of the gas turbine engine 20 for purposes of inspection or one or more components. As described further below, a nozzle system 120 (which is also configured for predetermined alignment) is connected to each one of the plurality of fluid wash lines 110 and configured for removable attachment with one of the plurality of engine ports 112. As will become further apparent from the description below, the nozzle system 120 enables a fluid nozzle (or a spray nozzle) to be releasably secured into an engine port and aligned at a predetermined direction or orientation within, for example, the core flow path C of the gas turbine engine 20. This feature ensures the nozzle does not separate from the engine when a pressurized flow of wash liquid is being distributed through the nozzle and into the engine and, further, ensures the pressurized flow of wash liquid is directed at the precise component (or portion of the component) where cleaning is intended to occur.

Figure 2A:
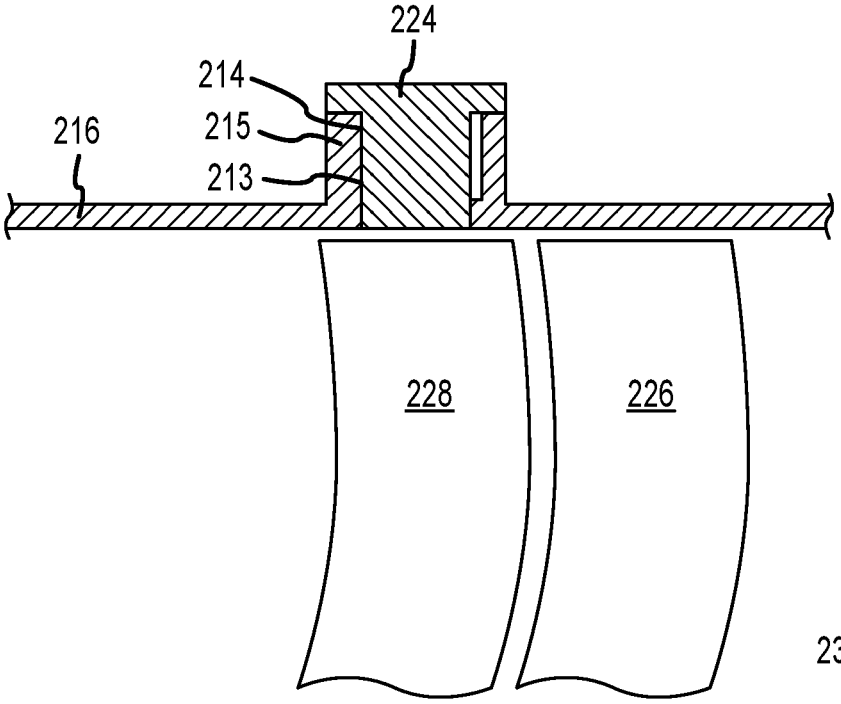
FIGS. 2A, 2B and 2C illustrate various aspects of a fluid wash system for a gas turbine engine, in accordance with various embodiments.
Figure 2C:
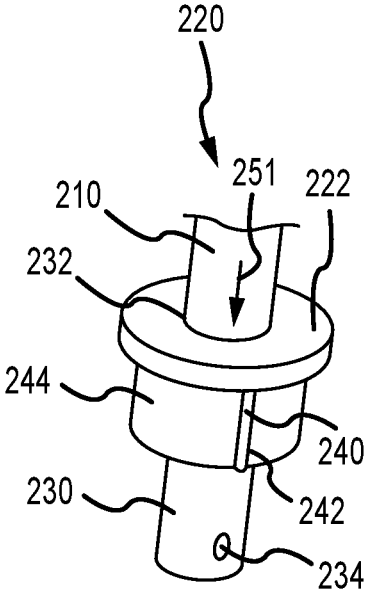
Figure 2B:
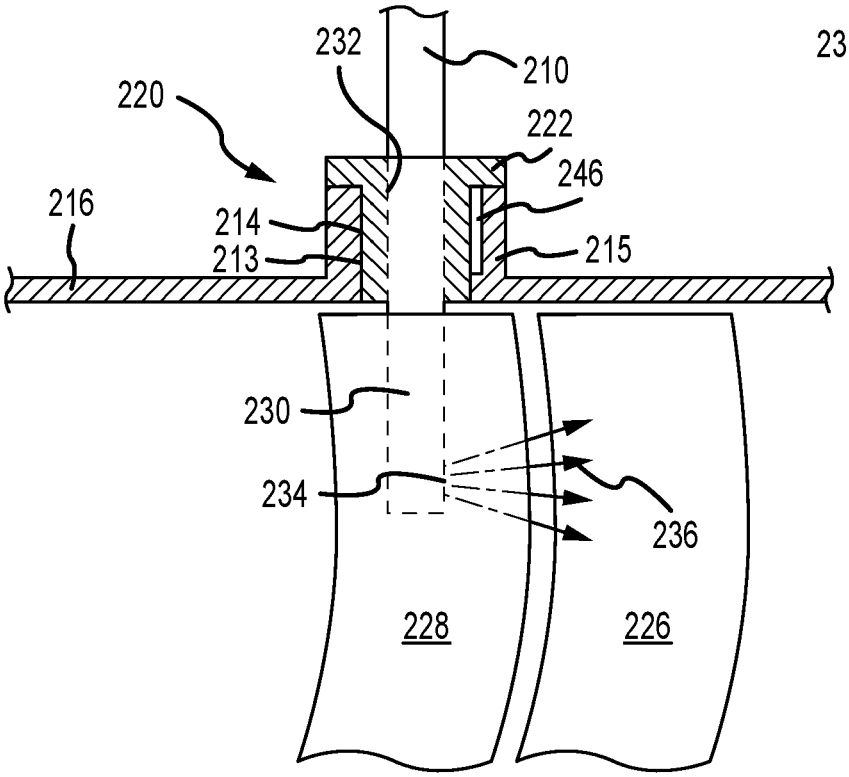

Referring now to FIGS. 2A, 2B and 2C, a nozzle system 220 is illustrated as part of a fluid wash system, such as, for example, the fluid wash system 100 described above with reference to FIG. 1. The nozzle system 220 (illustrated in FIGS. 2B and 2C) includes a base 222 configured for removable attachment with a borescope port 214. As illustrated, in various embodiments, the borescope port 214 comprises an aperture 213 that typically extends through a boss 215 that is either integral with (e.g., monolithic) or attached to an engine case 216. Referring to FIG. 2A, a plug 224 is illustrated as being disposed within the aperture 213 extending within the boss 215. The plug 224 is maintained within the boss 215 using typical methods, including, for example, threads or an external mounting system. Upon removal of the plug 224 from the boss 215, access may be had to the components of the gas turbine engine within the region of the boss 215, including, for example, a plurality of rotor blades 226 disposed downstream of a plurality of stator vanes 228 that are typically disposed in the same axial location as the boss 215. In various embodiments, the access referred to above is for insertion of a borescope for purposes of inspection.

Referring more particularly to FIGS. 2B and 2C, upon removal of the plug 224 from the boss 215, the nozzle system 220 may be inserted into the boss 215 and temporarily secured thereto. As illustrated, the nozzle system 220 includes the base 222 configured for attachment to the boss 215. A nozzle 230 is connected to a wash line 210 (e.g., one of the plurality of fluid wash lines 110 described above with reference to FIG. 1) and extends through an aperture 232 that extends through the base 222 and, in various embodiments, the nozzle 230 is held in a fixed position with respect to the base 222, either via a friction fit with the aperture 232 or by an adhesive or similar manner of attachment. The nozzle 230 includes an orifice 234, through which a pressurized wash fluid 236 is expelled toward one or more components within the gas turbine engine, including, for example, the plurality of rotor blades 226, during a fluid wash operation. As illustrated in FIG. 2B, the nozzle 230 generally extends radially inward toward the engine central axis A (see FIG. 1) and is disposed between a pair of vanes among the plurality of stator vanes 228 when the base 222 is fully positioned within the boss 215. In various embodiments, the nozzle 230 is either a first spray nozzle or a second spray nozzle, which may be oriented at a first predetermined direction or a second predetermined direction, respectively, with respect to component being washed.

Still referring particularly to FIGS. 2B and 2C, an alignment mechanism 240 is included within the nozzle system 220 to maintain the nozzle 230 at a fixed orientation during the fluid wash operation. In various embodiments, the alignment mechanism 240 includes a key 242 that extends outward from a surface 244 of the base 222. The key 242 in configured to fit within a slot 246 that is cut into a side of the aperture 232 that extends through the boss 215. When assembling the nozzle system 220 within the boss 215, the key 242 is aligned with the slot 246, thereby preventing the base 222, together with the nozzle 230, from rotating with respect to the boss 215 during a fluid wash operation. In various embodiments, a mark 251 may be included on a portion of the nozzle system 220 to indicate a direction of the pressurized wash fluid 236 as it leaves the orifice 234. In various embodiments, the base 222 is securely attached to the boss 215 using, for example, threads or an external mounting system. Secure attachment of the base 222 to the boss 215 prevents the base 222 and the nozzle 230 from becoming loose or being inadvertently removed during the fluid wash operation as well as maintaining the direction of the pressurized wash fluid 236 as it leaves the orifice 234. In addition, as the direction of the pressurized wash fluid 236 is generally fixed with respect to the base 222, different nozzle systems exhibiting different directions of the pressurized wash fluid with respect to the base 222 (or with respect to the boss 215) may be employed to achieve more complete washing of all components within the vicinity of the boss 215 during the fluid wash operation. As described in more detail below, various other alignment mechanisms are contemplated as being within the scope of the disclosure.

Figure 3A:
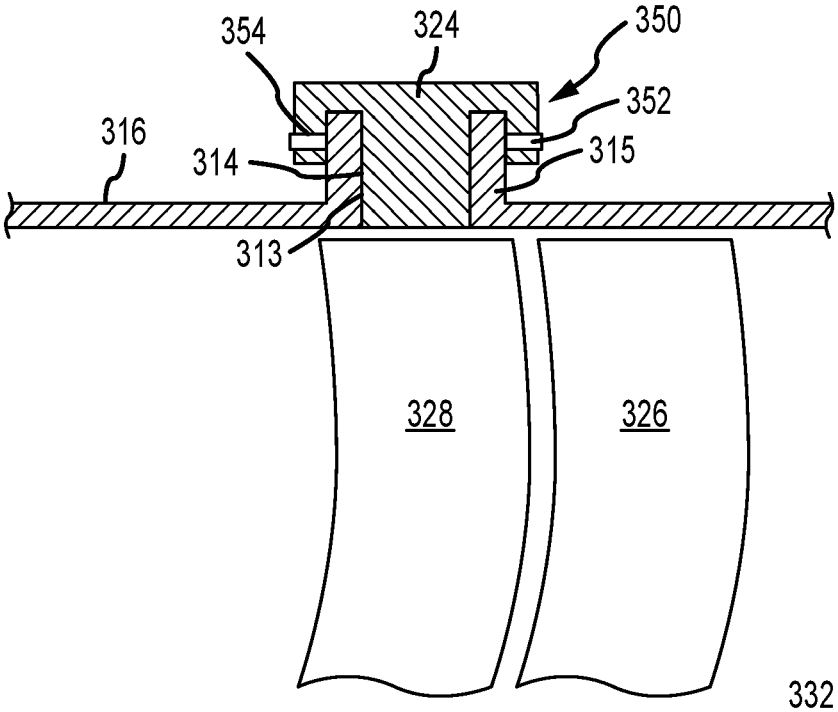
FIGS. 3A, 3B and 3C illustrate various aspects of a fluid wash system for a gas turbine engine, in accordance with various embodiments.
Figure 3C:
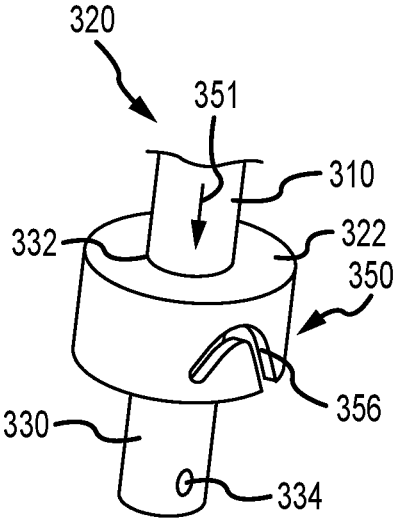
Figure 3B:
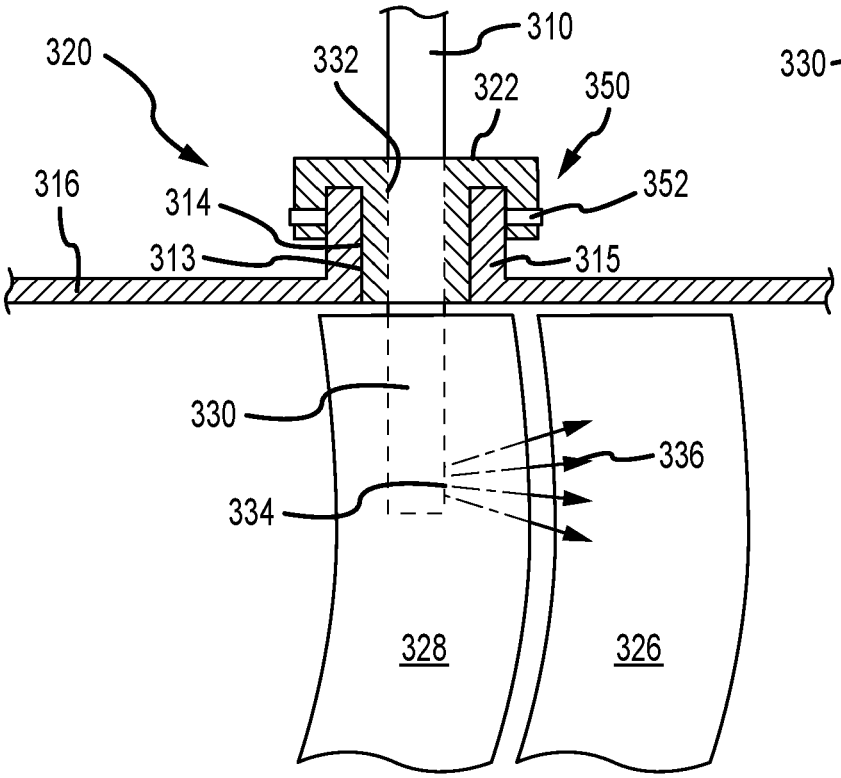

Referring now to FIGS. 3A, 3B and 3C, a nozzle system 320 is illustrated as part of a fluid wash system, such as, for example, the fluid wash system 100 described above with reference to FIG. 1. The nozzle system 320 (illustrated in FIGS. 3B and 3C) includes a base 322 configured for removable attachment with a borescope port 314. As illustrated, in various embodiments, the borescope port 314 comprises an aperture 313 that typically extends through a boss 315 that is either integral with (e.g., monolithic) or attached to an engine case 316. Referring to FIG. 3A, a plug 324 is illustrated as being disposed within the aperture 313 extending within the boss 315. The plug 324 is maintained within the boss 315 using a bayonet fixture 350, which, in various embodiments, includes a pin 352 that extends from the boss 315 and a curved slot 354 (see, e.g., the curved slot 356 illustrated in FIG. 3C) that is cut into the plug 324. Upon removal of the plug 324 from the boss 315 by twisting the plug with respect to the pin 352, access may be had to the components of the gas turbine engine within the region of the boss 315, including, for example, a plurality of rotor blades 326 disposed downstream of a plurality of stator vanes 328 that are typically disposed in the same axial location as the boss 315. In various embodiments, the access referred to above is for insertion of a borescope for purposes of inspection.

Referring more particularly to FIGS. 3B and 3C, upon removal of the plug 324 from the boss 315, the nozzle system 320 may be inserted into the boss 315 and temporarily secured thereto. As illustrated, the nozzle system 320 includes the base 322 configured for attachment to the boss 315. A nozzle 330 is connected to a wash line 310 (e.g., one of the plurality of fluid wash lines 110 described above with reference to FIG. 1) and extends through an aperture 332 that extends through the base 322 and, in various embodiments, the nozzle 330 is held in a fixed position with respect to the base 322, either via a friction fit with the aperture 332 or by an adhesive or similar manner of attachment. The nozzle 330 includes an orifice 334, through which a pressurized wash fluid 336 is expelled toward one or more components within the gas turbine engine, including, for example, the plurality of rotor blades 326, during a fluid wash operation. As illustrated in FIG. 3B, the nozzle 330 generally extends radially inward toward the engine central axis A (see FIG. 1) and is disposed between a pair of vanes among the plurality of stator vanes 328 when the base 322 is fully positioned within the boss 315. In various embodiments, the nozzle 330 is either a first spray nozzle or a second spray nozzle, which may be oriented at a first predetermined direction or a second predetermined direction, respectively, with respect to component being washed.

Still referring particularly to FIGS. 3B and 3C, an alignment mechanism 340 is included within the nozzle system 320 to maintain the nozzle 330 at a fixed orientation during the fluid wash operation. In various embodiments, the alignment mechanism 340 includes the pin 352 that extends from the boss 315 and a curved slot 356 that is cut into the base 322. When assembling the nozzle system 320 within the boss 315, the curved slot 356 is aligned with the pin 352 and the base 322 is rotated such that the pin 352 and the curved slot 356 become locked together, thereby preventing the base 322, together with the nozzle 330, from rotating with respect to the boss 315 during a fluid wash operation. In various embodiments, a mark 351 may be included on a portion of the nozzle system 320 to indicate a direction of the pressurized wash fluid 336 as it leaves the orifice 334. In various embodiments, the base 322 is securely attached to the boss 315 using, for example, the curved slot 356 and the pin 352. Secure attachment of the base 322 to the boss 315 prevents the base 322 and the nozzle 330 from becoming loose or being inadvertently removed during the fluid wash operation as well as maintaining the direction of the pressurized wash fluid 336 as it leaves the orifice 334. In addition, as the direction of the pressurized wash fluid 336 is generally fixed with respect to the base 322, different nozzle systems exhibiting different directions of the pressurized wash fluid with respect to the base 322 (or with respect to the boss 315) may be employed to achieve more complete washing of all components within the vicinity of the boss 315 during the fluid wash operation.

Figure 4A:
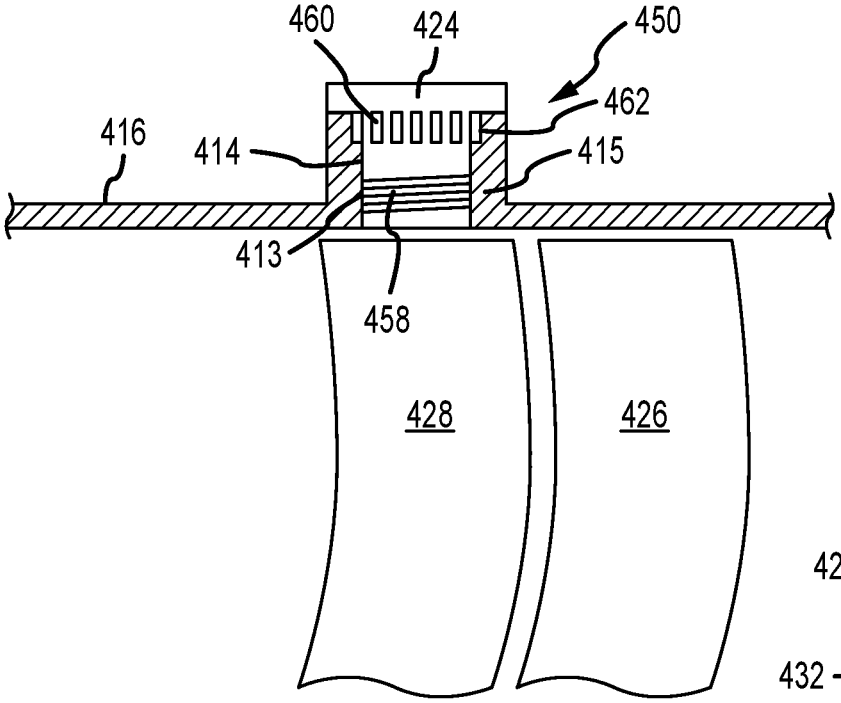
FIGS. 4A, 4B and 4C illustrate various aspects of a fluid wash system for a gas turbine engine, in accordance with various embodiments.
Figure 4C:
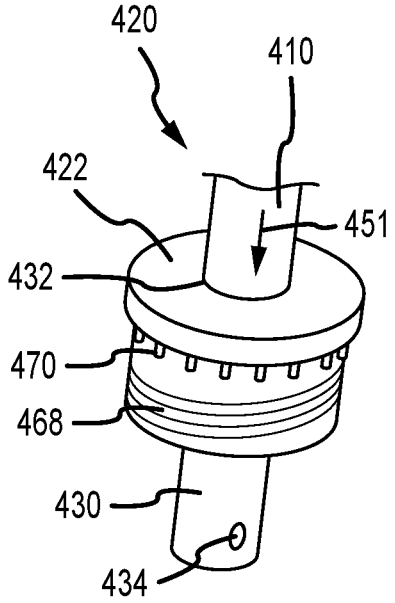
Figure 4B:
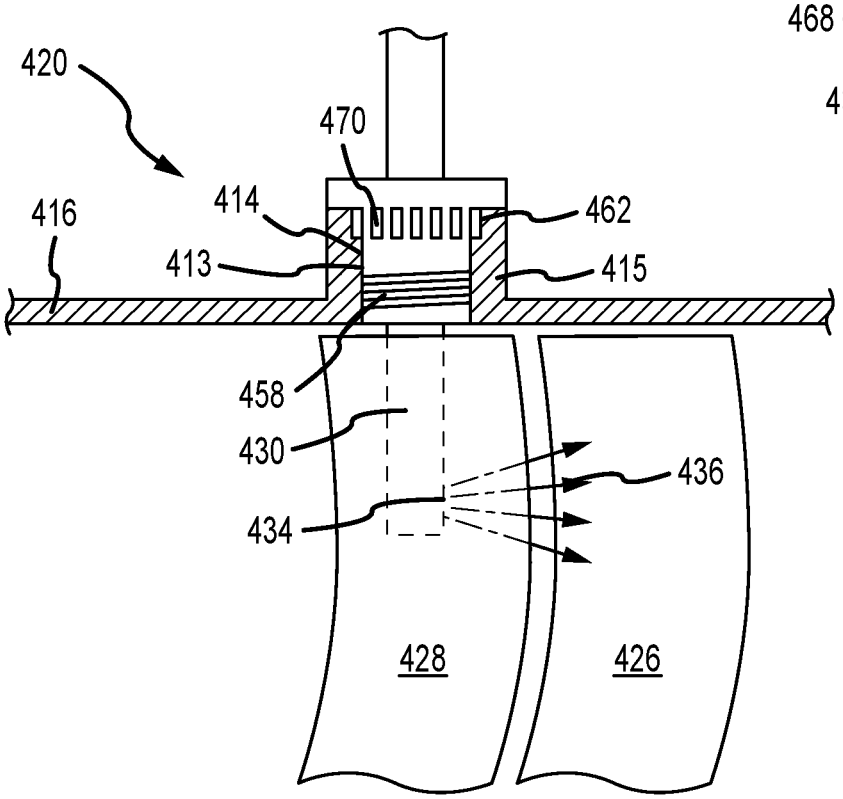

Referring now to FIGS. 4A, 4B and 4C, a nozzle system 420 is illustrated as part of a fluid wash system, such as, for example, the fluid wash system 100 described above with reference to FIG. 1. The nozzle system 420 (illustrated in FIGS. 4B and 4C) includes a base 422 configured for removable attachment with a borescope port 414. As illustrated, in various embodiments, the borescope port 414 comprises an aperture 413 that typically extends through a boss 415 that is either integral with (e.g., monolithic) or attached to an engine case 416. Referring to FIG. 4A, a plug 424 is illustrated as being disposed within the aperture 413 extending within the boss 415. The plug 424 is maintained within the boss 415 using a tine retainer fixture 450, which, in various embodiments, includes a threaded base 458 and a plurality of tines 460 that extend circumferentially about the plug 424 and that are configured to be received within a plurality of slots 462 cut into the boss 415. Such plugs may be obtained from Moeller Mfg. Company, LLC, of Wixom Mich., USA, under the trade name Moeller Click-Loc™ Self-Locking Plugs. Upon removal of the plug 424 from the boss 415 by twisting the plug 424 with respect to the boss 415, access may be had to the components of the gas turbine engine within the region of the boss 415, including, for example, a plurality of rotor blades 426 disposed downstream of a plurality of stator vanes 428 that are typically disposed in the same axial location as the boss 415. In various embodiments, the access referred to above is for insertion of a borescope for purposes of inspection.

Referring more particularly to FIGS. 4B and 4C, upon removal of the plug 424 from the boss 415, the nozzle system 420 may be inserted into the boss 415 and temporarily secured thereto. As illustrated, the nozzle system 420 includes the base 422 configured for attachment to the boss 415. A nozzle 430 is connected to a wash line 410 (e.g., one of the plurality of fluid wash lines 110 described above with reference to FIG. 1) and extends through an aperture 432 that extends through the base 422 and, in various embodiments, the nozzle 430 is held in a fixed position with respect to the base 422, either via a friction fit with the aperture 432 or by an adhesive or similar manner of attachment. The nozzle 430 includes an orifice 434, through which a pressurized wash fluid 436 is expelled toward one or more components within the gas turbine engine, including, for example, the plurality of rotor blades 426, during a fluid wash operation. As illustrated in FIG. 4B, the nozzle 430 generally extends radially inward toward the engine central axis A (see FIG. 1) and is disposed between a pair of vanes among the plurality of stator vanes 428 when the base 422 is fully positioned within the boss 415. In various embodiments, the nozzle 430 is either a first spray nozzle or a second spray nozzle, which may be oriented at a first predetermined direction or a second predetermined direction, respectively, with respect to component being washed.

Still referring particularly to FIGS. 4B and 4C, an alignment mechanism 440 is included within the nozzle system 420 to maintain the nozzle 430 at a fixed orientation during the fluid wash operation. In various embodiments, the alignment mechanism 440 includes the tine retainer fixture 450, which, in various embodiments, includes a threaded base 468 and a plurality of tines 470 that extend circumferentially about the base 422 and that are configured to be received within the plurality of slots 462 cut into the boss 415. When assembling the nozzle system 420 within the boss 415, the base 422 is threaded into the boss 415 until the plurality of tines 470 are engaged with the plurality of slots 462, thereby preventing the base 422, together with the nozzle 430, from rotating with respect to the boss 415 during a fluid wash operation. In various embodiments, a mark 451 may be included on a portion of the nozzle system 420 to indicate a direction of the pressurized wash fluid 436 as it leaves the orifice 434. In various embodiments, the base 422 is securely attached to the boss 415 using, for example, a threaded base 468 and corresponding threads cut into the boss 415. Secure attachment of the base 422 to the boss 415 prevents the base 422 and the nozzle 430 from becoming loose or being inadvertently removed during the fluid wash operation as well as maintaining the direction of the pressurized wash fluid 436 as it leaves the orifice 434. An added benefit of the nozzle system 420 is once the plurality of tines 470 is engaged with the plurality of slots 462, the nozzle 430 may still be rotated with respect to the base 422, thereby permitting adjustment of the direction of the pressurized wash fluid 436 during the fluid wash operation.

Figure 5:
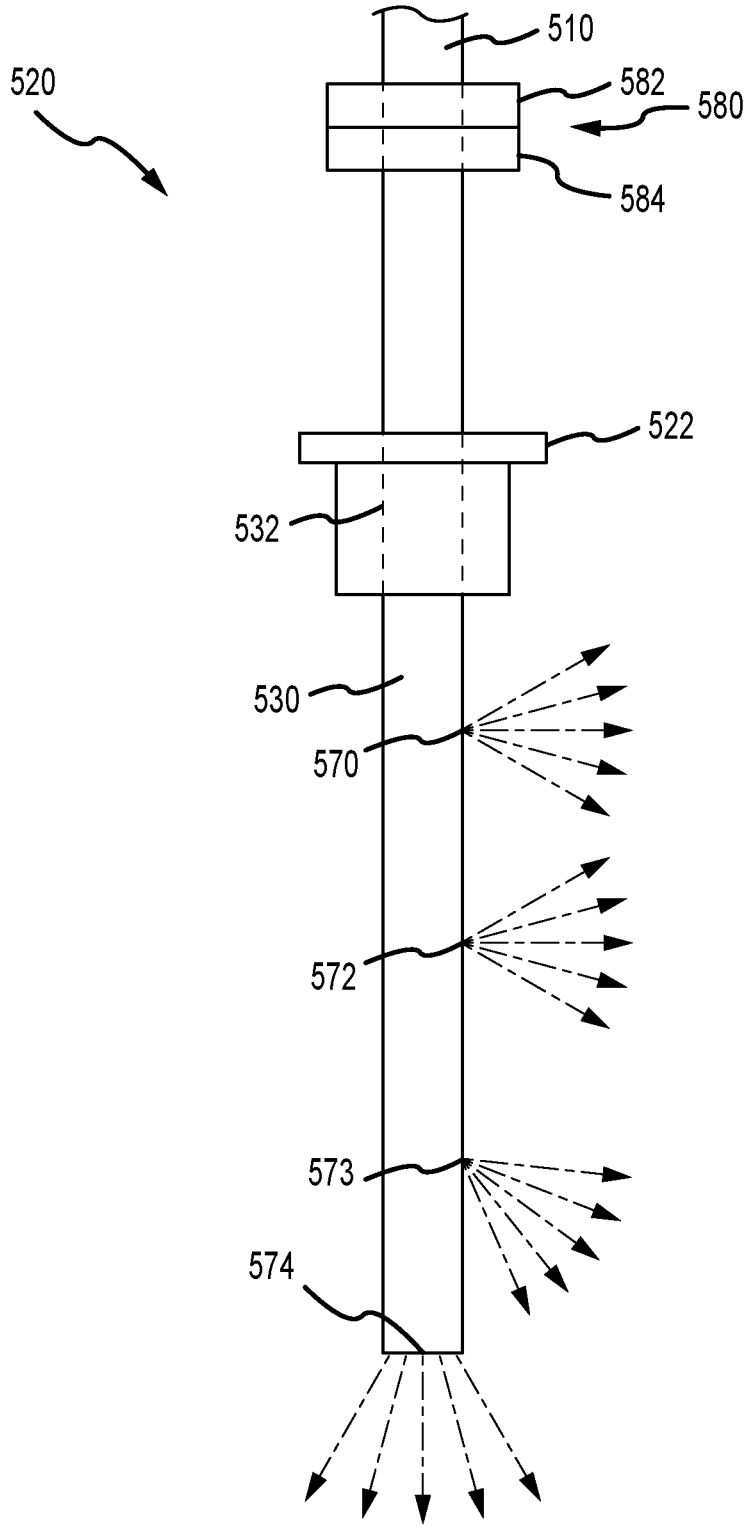
FIG. 5 illustrates a nozzle system as part of a fluid wash system, in accordance with various embodiments.

Referring now to FIG. 5, a nozzle system 520 is illustrated as part of a fluid wash system, such as, for example, the fluid wash system 100 described above with reference to FIG. 1. The nozzle system 520 includes a base 522 configured for removable attachment with a borescope port. In various embodiments, the base 522 may comprise, for example, the structure associated with any of the base 222, the base 322 and the base 422 described above with reference to FIGS. 2C, 3C and 4C, respectively, including the alignment mechanisms associated therewith. A nozzle 530 is connected to a wash line 510 (e.g., one of the plurality of fluid wash lines 110 described above with reference to FIG. 1) and extends through an aperture 532 that extends through the base 522 and, in various embodiments, the nozzle 530 is held in a fixed position with respect to the base 522, either via a friction fit with the aperture 532 or by an adhesive or similar manner of attachment. The nozzle 530 may include a plurality of orifices, including, for example, a first orifice 570 configured to expel pressurized wash fluid in a generally axial direction, a second orifice 572 configured to expel pressurized wash fluid in a generally axial direction, a third orifice 573 configured to expel pressurized wash fluid in a generally axial direction and a generally radial direction (e.g., at a forty-five degree (45°) angle toward an engine central axis A as illustrated in FIG. 1), and a fourth orifice 574 configured to expel pressurized wash fluid in a generally radial direction (e.g., toward the engine central axis A). Broadly speaking, in various embodiments, a predetermined direction of the pressurized flow of wash fluid may be within a range of about zero degrees (or an axial direction) to about ninety degrees (or a radial inward direction); and in various embodiments, the predetermined direction of the pressurized flow of wash fluid may be within a range of about thirty degrees to about sixty degrees. Such a configuration permits washing a relatively large area of the engine as opposed to configurations having a single orifice. Further, while the orifices just described are oriented in a generally aft or radially inward direction, the disclosure contemplates orienting the orifices in any direction, including both generally forward and generally aft directions, circumferential directions (e.g., to wash stator vanes), as well as radially inward and radially outward directions, or combinations of the foregoing directions. In addition, in various embodiments, a coupling mechanism 580 is included to enable quick attachment and release of the nozzle system 520 to the wash line 510. In various embodiments, the coupling mechanism 580 may comprise a quick release coupler that includes a first end 582 connected to the wash line 510 and a second end 584 connected to the nozzle 530 extending through the base 522. The coupling mechanism 580 enables, among other things, for the nozzle system 520 to be separated from the wash line 510 when not in use. The coupling mechanism 580 also enables the nozzle system 520 to be securely attached to a boss or other borescope port first, and then connected to the wash line 510 once securely attached.

Figure 6:
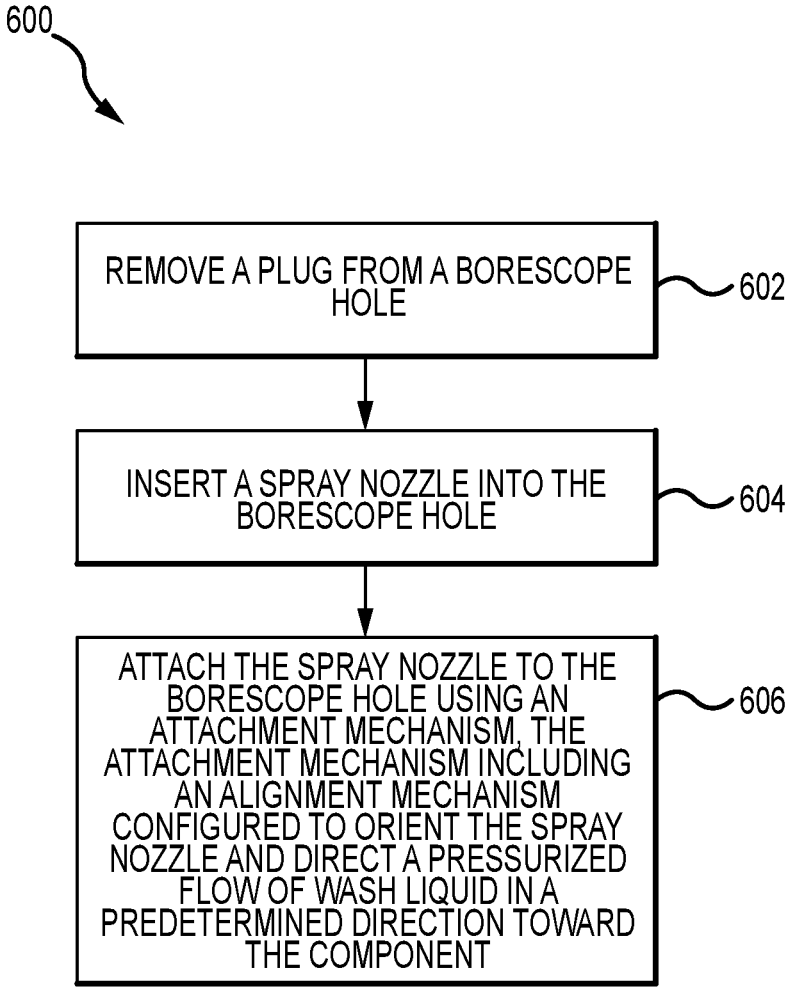
FIG. 6 describes various method steps involved in fluid washing a gas turbine engine, in accordance with various embodiments.

Referring now to FIG. 6, a method 600 of washing a gas turbine engine having a borescope hole providing access to a component within a core flow path is described as having at least the following steps. A first step 602 includes removing a plug from the borescope hole. A second step 604 includes inserting a spray nozzle into the borescope hole. A third step 606 includes attaching the spray nozzle to the borescope hole using an attachment mechanism, the attachment mechanism including an alignment mechanism configured to orient the spray nozzle and direct a pressurized flow of wash liquid in a predetermined direction toward the component. In various embodiments, the attachment mechanism includes a base and the alignment mechanism includes a key extending from the base and configured for engagement with a slot that is cut into a boss configured to receive the base. In various embodiments, the attachment mechanism includes a base and the alignment mechanism includes a slot that is cut into the base and configured to engage a pin extending from a boss configured to receive the base. In various embodiments, the attachment mechanism includes a base and the alignment mechanism includes a plurality of tines extending circumferentially about the base and configured to engage a plurality of slots that are cut into a boss configured to receive the base.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Numbers, percentages, or other values stated herein are intended to include that value, and also other values that are about or approximately equal to the stated value, as would be appreciated by one of ordinary skill in the art encompassed by various embodiments of the present disclosure. A stated value should therefore be interpreted broadly enough to encompass values that are at least close enough to the stated value to perform a desired function or achieve a desired result. The stated values include at least the variation to be expected in a suitable industrial process, and may include values that are within 10%, within 5%, within 1%, within 0.1%, or within 0.01% of a stated value. Additionally, the terms "substantially," "about" or "approximately" as used herein represent an amount close to the stated amount that still performs a desired function or achieves a desired result. For example, the term "substantially," "about" or "approximately" may refer to an amount that is within 10% of, within 5% of, within 1% of, within 0.1% of, and within 0.01% of a stated amount or value.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

Finally, it should be understood that any of the above described concepts can be used alone or in combination with any or all of the other above described concepts. Although various embodiments have been disclosed and described, one of ordinary skill in this art would recognize that certain modifications would come within the scope of this disclosure. Accordingly, the description is not intended to be exhaustive or to limit the principles described or illustrated herein to any precise form. Many modifications and variations are possible in light of the above teaching.

What is claimed is:

1. A fluid wash system for a gas turbine engine, the gas turbine engine defining an axial direction and comprising a borescope port that provides access to a component within a core flow path of the gas turbine engine, the fluid wash system comprising:

a wash line fluidly connected to a pump configured to provide a pressurized flow of wash liquid;

a spray nozzle connected to the wash line and configured for extending into the borescope port to provide the pressurized flow of wash liquid to the component within the core flow path; and an attachment mechanism configured to releasably mount the spray nozzle to the borescope port, the attachment mechanism including an alignment mechanism configured to orient the spray nozzle and direct the pressurized flow of wash liquid in a predetermined direction toward the component, wherein the attachment mechanism includes a base and the alignment mechanism includes a key extending from an outer surface of the base and configured for engagement with a slot that is cut into a side of a boss configured to receive the base.

2. The fluid wash system of claim 1, wherein the spray nozzle includes an orifice configured to expel the pressurized flow of wash liquid toward the component.

3. The fluid wash system of claim 2, wherein the predetermined direction is within a range of about zero degrees to about ninety degrees in a radial inward direction with respect to the axial direction.

4. The fluid wash system of claim 2, wherein the spray nozzle is a first spray nozzle configured for mounting to the attachment mechanism and configured for orientation with respect to the component at a first predetermined direction and wherein the fluid wash system further comprises a second spray nozzle configured for mounting to the attachment mechanism and configured for orientation with respect to the component at a second predetermined direction.

5. The fluid wash system of claim 1, wherein the spray nozzle includes a plurality of orifices configured to expel the pressurized flow of wash liquid toward the component.

6. The fluid wash system of claim 1, wherein the slot is configured to engage a pin extending from the boss configured to receive the base.

7. The fluid wash system of claim 6, wherein the spray nozzle includes an orifice configured to expel the pressurized flow of wash liquid toward the component in a direction within a range of about zero degrees to about ninety degrees in a radial inward direction with respect to the axial direction.

8. The fluid wash system of claim 6, wherein the spray nozzle includes a plurality of orifices configured to expel the pressurized flow of wash liquid toward the component.

9. The fluid wash system of claim 1, wherein the alignment mechanism includes a plurality of tines extending circumferentially about the base and configured to engage a plurality of slots that are cut into the boss configured to receive the base.

10. The fluid wash system of claim 9, wherein the spray nozzle includes an orifice configured to expel the pressurized flow of wash liquid toward the component in a direction within a range of about zero degrees to about ninety degrees in a radial inward direction with respect to the axial direction and wherein the spray nozzle is rotatable with respect to the base.

11. The fluid wash system of claim 9, wherein the spray nozzle includes a plurality of orifices configured to expel the pressurized flow of wash liquid toward the component.

12. A fluid wash system for a gas turbine engine, the gas turbine engine defining an axial direction and comprising a plurality of borescope ports, the fluid wash system comprising:

a pump configured to output a pressurized flow of wash liquid;

a nozzle distribution assembly fluidly connected to the pump for receiving the pressurized flow of wash liquid;

a plurality of wash lines fluidly connected to the nozzle distribution assembly; and a plurality of spray nozzles, each of the plurality of spray nozzles connected by an attachment mechanism to a respective one of the plurality of wash lines and configured for extending at least partially into or through one of the plurality of borescope ports of the gas turbine engine for providing a portion of the pressurized flow of wash liquid to a component within the gas turbine engine, the attachment mechanism including an alignment mechanism, wherein the attachment mechanism includes a base and the alignment mechanism includes a key extending from an outer surface of the base and configured for engagement with a slot that is cut into a side of a boss configured to receive the base.

13. The fluid wash system of claim 12, wherein the attachment mechanism includes a base and the alignment mechanism includes a slot that is cut into the base and the slot is configured to engage a pin extending from the boss configured to receive the base.

14. The fluid wash system of claim 12, wherein the alignment mechanism includes a plurality of tines extending circumferentially about the base and configured to engage a plurality of slots that are cut into the boss configured to receive the base.

* * * * *